US010655201B2

(12) United States Patent
Kariya et al.

(10) Patent No.: US 10,655,201 B2
(45) **Date of Patent: *May 19, 2020**

(54) HIGH-STRENGTH COLD-ROLLED STEEL SHEET AND METHOD FOR MANUFACTURING THE SAME

(71) Applicant: JFE STEEL CORPORATION, Tokyo (JP)

(72) Inventors: Nobusuke Kariya, Fukuyama (JP); Yoshihiko Ono, Fukuyama (JP); Yoshimasa Funakawa, Chiba (JP); Kazuma Mori, Chiba (JP); Reiko Sugihara, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 155 days.

This patent is subject to a terminal disclaimer.

(21) Appl. No.: 15/557,547

(22) PCT Filed: Feb. 16, 2016

(86) PCT No.: PCT/JP2016/000779

§ 371 (c)(1),
(2) Date: Sep. 12, 2017

(87) PCT Pub. No.: WO2016/147550

PCT Pub. Date: Sep. 22, 2016

(65) Prior Publication Data

US 2018/0057919 A1 Mar. 1, 2018

(30) Foreign Application Priority Data

Mar. 13, 2015 (JP) ..... 2015-050105

(51) Int. Cl.

| | |
|---|---|
| ***C21D 9/46*** | (2006.01) |
| ***C22C 38/60*** | (2006.01) |
| ***C22C 38/00*** | (2006.01) |
| ***C22C 38/46*** | (2006.01) |
| ***C21D 8/02*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(52) U.S. Cl.

CPC ..... *C22C 38/60* (2013.01); *C21D 8/0236* (2013.01); *C21D 9/46* (2013.01); *C22C 38/00* (2013.01); *C22C 38/005* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 8/0226* (2013.01); *C21D 2211/002* (2013.01); *C21D 2211/005* (2013.01); *C21D 2211/008* (2013.01)

(58) Field of Classification Search

CPC ..... C21D 2211/002; C21D 2211/005; C21D 2211/008; C21D 8/0226; C21D 8/0236; C21D 9/46; C22C 38/00

USPC ..... 148/335

See application file for complete search history.

(56) References Cited

U.S. PATENT DOCUMENTS

| | | | | |
|---|---|---|---|---|
| 8,628,630 | B2 | 1/2014 | Kobayashi et al. | |
| 10,156,005 | B2 * | 12/2018 | Takashima | C22C 38/14 |
| 2007/0006948 | A1 * | 1/2007 | Nonaka | C22C 38/02 148/603 |
| 2011/0017363 | A1 | 1/2011 | Kang et al. | |
| 2011/0030857 | A1 | 2/2011 | Kwak et al. | |
| 2012/0040203 | A1 | 2/2012 | Takagi et al. | |
| 2012/0216925 | A1 | 8/2012 | Kobayashi et al. | |
| 2013/0133792 | A1 | 5/2013 | Nakagaito et al. | |
| 2014/0342184 | A1 | 11/2014 | Takagi et al. | |

FOREIGN PATENT DOCUMENTS

| | | | |
|---|---|---|---|
| CN | 101910439 | A | 12/2010 |
| CN | 102414335 | A | 4/2012 |

(Continued)

OTHER PUBLICATIONS

Korean Office Action for Korean Application No. 10-2017-7024818, dated Nov. 19, 2018 with Concise Statement of Relevance of Office Action, 5 pages.

(Continued)

*Primary Examiner* — Jie Yang
(74) *Attorney, Agent, or Firm* — RatnerPrestia

(57) ABSTRACT

A high-strength, cold-rolled steel sheet having a tensile strength of 980 MPa or more, the steel sheet having a chemical composition containing, by mass %, C: 0.070% to 0.100%, Si: 0.50% to 0.70%, Mn: 2.40% to 2.80%, P: 0.025% or less, S: 0.0020% or less, Al: 0.020% to 0.060%, N: 0.0050% or less, Nb: 0.010% to 0.060%, Ti: 0.010% to 0.030%, B: 0.0005% to 0.0030%, Sb: 0.005% to 0.015%, Ca: 0.0015% or less, Cr: 0.01% to 2.00%, Mo: 0.01% to 1.00%, Ni: 0.01% to 5.00%, Cu: 0.01% to 5.00%, and the balance being Fe and inevitable impurities, a metallurgical microstructure including a ferrite phase in an amount of 30% or more in terms of area fraction, at least one selected from a bainite phase and a martensite phase in an amount of 40% to 65% in total in terms of area fraction, and a cementite in an amount of 5% or less in terms of area fraction at a position located at ¼ of the thickness from the surface of the steel sheet, and a metallurgical microstructure including a ferrite phase in an amount of 40% to 55% in terms of area fraction at a position located at 50 μm in the thickness direction from the surface of the steel sheet and a method for manufacturing the steel sheet.

4 Claims, No Drawings

(56) References Cited

FOREIGN PATENT DOCUMENTS

| | | | |
|---|---|---|---|
| CN | 102482750 | A | 5/2012 |
| CN | 104024452 | A | 9/2014 |
| CN | 104040000 | A | 9/2014 |
| EP | 1637618 | A1 | 3/2006 |
| EP | 2138599 | A1 | 12/2009 |
| EP | 2243852 | A1 | 10/2010 |
| EP | 2426230 | A1 | 3/2012 |
| EP | 2801636 | A1 | 11/2014 |
| JP | 10280090 | A | 10/1998 |
| JP | 2001335890 | A | 12/2001 |
| JP | 2002249846 | A | 9/2002 |
| JP | 2007231395 | A | 9/2007 |
| JP | 2008156734 | A | 7/2008 |
| JP | 2010059452 | A | 3/2010 |
| JP | 2011508085 | A | 3/2011 |
| JP | 2011523441 | A | 8/2011 |
| KR | 1020130006507 | A | 1/2013 |
| WO | 2009084795 | A1 | 7/2009 |
| WO | 2009142361 | A1 | 11/2009 |
| WO | 2010126161 | A1 | 11/2010 |
| WO | 2011021724 | A1 | 2/2011 |
| WO | 2013100485 | A1 | 7/2013 |

OTHER PUBLICATIONS

International Search Report and Written Opinion for International Application No. PCT/JP2016/000779, dated Apr. 26, 2016—5 Pages.

Extended European Search Report for European Application No. 16764384.0, dated Nov. 17, 2017, 8 pages.

Chinese Office Action with Concise Statement of Relevance for Chinese Application No. 201680013813.1, dated May 30, 2018, 6 pages.

Non Final Office Action for Application No. 14/911,088, dated Jan. 12, 2018, 15 pages.

Final Office Action for Application No. 14/911,088, dated Jun. 5, 2018, 14 pages.

* cited by examiner

HIGH-STRENGTH COLD-ROLLED STEEL SHEET AND METHOD FOR MANUFACTURING THE SAME

CROSS REFERENCE TO RELATED APPLICATIONS

This is the U.S. National Phase application of PCT/JP2016/000779, filed Feb. 16, 2016, which claims priority to Japanese Patent Application No. 2015-050105, filed Mar. 13, 2015, the disclosures of these applications being incorporated herein by reference in their entireties for all purposes.

TECHNICAL FIELD OF THE INVENTION

The present invention relates to a high-strength cold-rolled steel sheet having a tensile strength of 980 MPa or more and a method for manufacturing the steel sheet. The high-strength cold-rolled steel sheet according to the present invention is excellent in bendability and can preferably be used for, for example, automobile parts.

BACKGROUND OF THE INVENTION

In recent years, attempts have been made to reduce exhaust gases such as $CO_2$ from the viewpoint of global environment conservation. In the automobile industry, measures have been taken to reduce the amount of exhaust gases by increasing fuel efficiency through the weight reduction of an automobile body.

Examples of a method for reducing the weight of an automobile body include a method in which the thickness of a cold-rolled steel sheet used for an automobile is decreased by increasing the strength of the steel sheet. However, since it is known that there is a problem with this method in that bendability decreases with an increase in the strength of a cold-rolled steel sheet, there is a demand for a cold-rolled steel sheet having a high strength and satisfactory bendability at the same time. There is a tendency for a variation in mechanical properties within a high-strength cold-rolled steel sheet to increase with an increase in the strength level of the cold-rolled steel sheet. Therefore, there is a demand for an increase in the stability of bendability within a cold-rolled steel sheet from the viewpoint of increasing material yield in the case where a part is manufactured by performing form forming which involves many portions to be subjected to bending. Here, generally, it is possible to use the ratio of a limit bending radius to a thickness (R/t) as an index for evaluating the stability of bendability, and it is possible to judge that the smaller the value of R/t is, the more stable the bendability within a cold-rolled steel sheet is.

In response to the requirement described above, for example, Patent Literature 1 discloses a high-strength cold-rolled steel sheet having a tensile strength of 780 MPa to 1470 MPa, good shape, and excellent bendability and a method for manufacturing the steel sheet. When a steel sheet having a chemical composition within a specified range is reheated after overcooling has been performed without stopping cooling at a specified bainite transformation temperature, tempered martensite is partially mixed into a microstructure or various kinds of bainite different in hardness from each other exist as a result of transformation occurring at different temperatures. Even in such a case, Patent Literature 1 discloses that, when the volume fraction of a retained austenite phase having an Ms transformation temperature of −196° C. or higher is 2% or less, there is practically no decrease in bendability compared with a case where cooling is stopped at a specified bainite transformation temperature, and there is a significant improvement in shape compared with the case where cooling is first performed to room temperature and reheating is then performed. Although bendability is evaluated by performing a 90-degree-bending test, since no consideration is given to a position to be evaluated, the stability of bendability is not disclosed.

Patent Literature 2 discloses a steel sheet excellent in bendability and drilling resistance. Patent Literature 2 discloses a method in which bendability is increased, for example, by rapidly cooling a steel sheet after rolling has been performed or after rolling followed by reheating has been performed in order to form a microstructure including mainly martensite or a mixed microstructure including martensite and lower bainite and by controlling the value of Mn/C to be constant over the full range of the C content. Although bendability is evaluated by using a press bending method, since no consideration is given to a position to be evaluated, the stability of bendability is not disclosed. Moreover, although specification regarding Brinell hardness is disclosed, specification regarding tensile strength is not disclosed.

Patent Literature 3 discloses a high-strength steel sheet excellent in bendability and a method for manufacturing the steel sheet. Patent Literature 3 discloses a method in which a steel sheet having good close-contact bending capability in any one of the rolling direction, the width direction, and the 45-degree direction is manufactured by heating steel having a specified chemical composition, performing rough rolling, performing hot finish rolling which is started at a temperature of 1050° C. or lower and finished in a temperature range from the $Ar_3$ transformation temperature to (the $Ar_3$ transformation temperature+100° C.), cooling the hot-rolled steel sheet at a cooling rate of 20° C./s or less, coiling the cooled steel sheet at a temperature of 600° C. or higher, performing pickling, performing cold rolling with a rolling reduction of 50% to 70%, performing annealing for 30 seconds to 90 seconds in a temperature range in which an ($\alpha+\gamma$)-dual phase is formed, and cooling the annealed steel sheet to a temperature of 550° C. at a cooling rate of 5° C./s or more. Although bendability is evaluated by performing close-contact bending, since no consideration is given to a position to be evaluated, the stability of bendability is not disclosed. Moreover, although tensile properties are evaluated by performing a tensile test, since the steel sheet has a strength of 980 MPa or less, the steel sheet has insufficient strength to be used as a high-strength steel sheet for an automobile.

PATENT LITERATURE

PTL 1: Japanese Unexamined Patent Application Publication No. 10-280090

PTL 2: Japanese Unexamined Patent Application Publication No. 2007-231395

PTL 3: Japanese Unexamined Patent Application Publication No. 2001-335890

SUMMARY OF THE INVENTION

In certain embodiments of the present invention a high-strength cold-rolled steel sheet having a tensile strength of 980 MPa or more excellent in bendability and strength-ductility balance (TS×El) and a method for manufacturing the steel sheet is provided.

From the viewpoint of chemical composition and metallurgical microstructure it was determined that it is very important to control a chemical composition to be within an appropriate range and to appropriately control a metallurgical microstructure. In addition, it was determined that, by forming a metallurgical microstructure including a ferrite phase in an amount of 30% or more in terms of area fraction, a bainite phase and/or a martensite phase in an amount of 40% to 65% in terms of area fraction, and cementite in an amount of 5% or less in terms of area fraction at a position located at ¼ of the thickness from the surface of the steel sheet and a metallurgical microstructure including a ferrite phase in an amount of 40% to 55% in terms of area fraction at a position located at 50 μm in the thickness direction from the surface of the steel sheet, it is possible to achieve a tensile strength of 980 MPa or more and stable bendability within a cold-rolled steel sheet. Moreover, it was surprisingly determined that it is possible to realize not only excellent strength and stable bendability but also excellent strength-ductility balance.

In embodiments according to the present invention, a metallurgical microstructure is a multi-phase microstructure including a ferrite phase and a martensite phase and/or a bainite phase in order to achieve good bendability. It is possible to form such a multi-phase microstructure by cooling a steel sheet to a specified temperature after annealing has been performed. However, when there is an increase in the area fraction of a ferrite phase in the surface layer of the steel sheet due to a decrease in the hardenability of the surface layer of a steel sheet as a result of a decrease in the amount of B (boron) in the surface layer of the steel sheet caused by an atmosphere during cooling or annealing, C is concentrated in an austenite phase, a hard martensite phase or a hard bainite phase may be formed in the surface layer of the steel sheet. In the case where the metallurgical microstructure of the surface layer of a steel sheet is a multi-phase microstructure including a ferrite phase and a hard martensite phase and/or a hard bainite phase, since there is an increase in the difference in hardness among the phases, it is not possible to stably achieve high bendability within a cold-rolled steel sheet.

In contrast, embodiments according to the present invention have made it possible to achieve a tensile strength of 980 MPa or more and to stably achieve good bendability within a cold-rolled steel sheet in the case of a multi-phase microstructure including a ferrite phase, a bainite phase and/or a martensite phase, and cementite by specifying a chemical composition, in particular, the Sb content, and a metallurgical microstructure as described above. That is, regarding a metallurgical microstructure at a position located at ¼ of the thickness from the surface of a steel sheet, the area fraction of a ferrite phase is specified in order to achieve satisfactory strength and ductility, and the area fractions of bainite phase and/or martensite phase and cementite are appropriately controlled in order to achieve satisfactory strength and bendability. Moreover, at a position located at 50 μm in the thickness direction from the surface of a steel sheet, the area fraction of a ferrite phase is appropriately controlled in order to make it possible to stably achieve high bendability within a cold-rolled steel sheet. Moreover, it is possible to realize not only excellent strength and stable bendability but also excellent strength-ductility balance.

Embodiments according to the present invention are as follows:

[1] A high-strength, cold-rolled steel sheet having a tensile strength of 980 MPa or more, the steel sheet having a chemical composition containing, by mass %, C: 0.070% to 0.100%, Si: 0.50% to 0.70%, Mn: 2.40% to 2.80%, P: 0.025% or less, S: 0.0020% or less, Al: 0.020% to 0.060%, N: 0.0050% or less, Nb: 0.010% to 0.060%, Ti: 0.010% to 0.030%, B: 0.0005% to 0.0030%, Sb: 0.005% to 0.015%, Ca: 0.0015% or less, Cr: 0.01% to 2.00%, Mo: 0.01% to 1.00%, Ni: 0.01% to 5.00%, Cu: 0.01% to 5.00%, and the balance being Fe and inevitable impurities, a metallurgical microstructure including a ferrite phase in an amount of 30% or more in terms of area fraction, at least one selected from a bainite phase and a martensite phase in an amount of 40% to 65% in total in terms of area fraction, and a cementite in an amount of 5% or less in terms of area fraction at a position located at ¼ of the thickness from the surface of the steel sheet, and a metallurgical microstructure including a ferrite phase in an amount of 40% to 55% in terms of area fraction at a position located at 50 μm in the thickness direction from the surface of the steel sheet.

[2] The high-strength, cold-rolled steel sheet having a tensile strength of 980 MPa or more according to item [1], the chemical composition further containing, by mass %, at least one selected from V: 0.005% to 0.100% and REM: 0.0010% to 0.0050%.

[3] A method for manufacturing a high-strength, cold-rolled steel sheet having a tensile strength of 980 MPa or more, the method including: hot rolling a steel material having the chemical composition according to item [1] or [2] with a finishing delivery temperature of the Ara transformation temperature or more, coiling the hot-rolled steel sheet at a temperature of 600° C. or lower, performing pickling followed by cold rolling, and then performing an annealing treatment, Wherein the annealing treatment comprises heating the cold-rolled steel sheet to a temperature of 600° C. or lower at an average heating rate of 0.15° C./min or less, holding the cold-rolled steel sheet at an annealing temperature of 700° C. to $(Ac_3-5)$° C. for 5 hours to 50 hours, and then cooling the cold-rolled steel sheet to a temperature of 620° C. or higher at an average cooling rate of 1.2° C./min or more.

Here, in embodiments of the present invention, the term "high strength" refers to a case of a tensile strength TS of 980 MPa or more. According to embodiments of the present invention, in particular, it is possible to provide a cold-rolled steel sheet having a tensile strength of 980 MPa to 1150 MPa excellent in terms of bendability and strength-ductility balance.

According to embodiments of the present invention, it is possible to obtain a high-strength cold-rolled steel sheet having a tensile strength of 980 MPa or more excellent in bendability and strength-ductility balance. Since the high-strength, cold-rolled steel sheet according to embodiments of the present invention is stably excellent in bendability within a cold-rolled steel sheet, the steel sheet has a significant potential in the industry, because, for example, by using the steel sheet for the structural members of an automobile, it is possible to increase fuel efficiency due to the weight reduction of an automobile body, and it is possible to realize a high yield of parts.

DETAILED DESCRIPTION OF THE INVENTION

Hereafter, embodiments of the present invention will be specifically described. Here, in the description below, the content of each of the chemical elements in the chemical composition of steel is expressed in units of "mass %", and "mass %" is simply referred to as "%" unless otherwise noted.

First, the chemical composition will be described.

C: 0.070% to 0.100%

C is a chemical element which is indispensable for achieving the desired strength and for increasing strength and ductility by forming a multi-phase metallurgical microstructure, and it is necessary that the C content be 0.070% or more for such purposes. On the other hand, when the C content is more than 0.100%, there is a significant increase in strength, it is not possible to achieve the desired bendability. Therefore, the C content is set to be 0.070% to 0.100%.

Si: 0.50% to 0.70%

Si is a chemical element which is effective for increasing the strength of steel without significantly decreasing the ductility of steel and which is important for controlling the area fraction of a ferrite phase at a position located at 50 μm from the surface of a steel sheet. Therefore, it is necessary that the Si content be 0.50% or more. However, when the Si content is more than 0.70%, since there is a significant increase in strength, it is not possible to achieve the desired bendability. Therefore, the Si content is set to be 0.50% to 0.70%, or preferably 0.55% to 0.70%

Mn: 2.40% to 2.80%

Mn is a chemical element which is, like C, indispensable for achieving the desired strength and which is important for controlling the formation of a ferrite phase during cooling in an annealing process by stabilizing an austenite phase. For such purposes, it is necessary that the Mn content be 2.40% or more. However, when the Mn content is more than 2.80%, since the area fractions of a bainite phase and/or a martensite phase formed become excessively large, it is not possible to achieve the desired bendability. Therefore, the Mn content is set to be 2.80% or less. It is preferable that the Mn content be 2.50% to 2.80%.

P: 0.025% or Less

Since P is a chemical element which is effective for increasing the strength of steel, P may be added in accordance with the strength level of a steel sheet, and it is preferable that the P content be 0.005% or more in order to realize such an effect. On the other hand, when the P content is more than 0.025%, there is a decrease in weldability. Therefore, the P content is set to be 0.025% or less. It is preferable that the P content be 0.020% or less in the case where a higher level of weldability is required.

S: 0.0020% or Less

Since S forms non-metal inclusions such as MnS, and since cracking tends to occur at the interface between the non-metal inclusions and a metallurgical microstructure in a bending test, it is not possible to achieve the desired bendability. It is preferable that the S content be as small as possible, and the S content is set to be 0.0020% or less. In addition, it is preferable that the S content be 0.0015% or less when a higher level of bendability is required.

Al: 0.020% to 0.060%

The Al content is set to be 0.020% or more for the purpose of the deoxidation of steel. On the other hand, when the Al content is more than 0.060%, there is a decrease in surface quality. Therefore, the Al content is set to be 0.020% to 0.060%

N: 0.0050% or Less

When N combines with B to form B nitrides, since there is a decrease in the amount of B, which increases hardenability during cooling in an annealing process, there is an increase in the area fraction of a ferrite phase at a position located at 50 μm in the thickness direction from the surface of a steel sheet, which makes it impossible to achieve the desired bendability. Therefore, it is preferable that the N content be as small as possible in certain embodiments of the present invention. Therefore, the N content is set to be 0.0050% or less, or preferably 0.0040% or less.

Nb: 0.010% to 0.060%

Nb is a chemical element which is effective for increasing the strength of steel and for decreasing the crystal grain diameter of a metallurgical microstructure by forming carbonitrides in steel, and the Nb content is set to be 0.010% or more in order to realize such effects. On the other hand, when the Nb content is more than 0.060%, since there is a significant increase in strength, it is not possible to achieve the desired bendability. Therefore, the Nb content is set to be 0.010% to 0.060%. It is preferable that the lower limit of the Nb content be 0.020% or more and that the upper limit of the Nb content be 0.050% or less.

Ti: 0.010% to 0.030%

Ti is a chemical element which is, like Nb, effective for increasing the strength of steel and for decreasing the crystal grain diameter of a metallurgical microstructure by forming carbonitrides in steel and which inhibits the formation of B nitrides, which decrease hardenability. The Ti content is set to be 0.010% or more in order to realize such effects. On the other hand, when the Ti content is more than 0.030%, since there is a significant increase in strength, it is not possible to achieve the desired bendability. Therefore, the Ti content is set to be 0.010% to 0.030%. It is preferable that the lower limit of the Ti content be 0.012% or more and that the upper limit of the Ti content be 0.022% or less.

B: 0.0005% to 0.0030%

B is a chemical element which is important for controlling the formation of a ferrite phase during cooling in an annealing process by increasing the hardenability of steel and which is effective for controlling the area fraction of a ferrite phase at a position located at 50 μm in the thickness direction from the surface of a steel sheet. The B content is set to be 0.0005% or more in order to realize such effects. On the other hand, when the B content is more than 0.0030%, such effects become saturated, and there is an increase in rolling load in hot rolling and cold rolling. Therefore, the B content is set to be 0.0005% to 0.0030%, or preferably 0.0005% to 0.0025%.

Sb: 0.005% to 0.015%

Sb is the most important chemical element in certain embodiments of the present invention. That is, as a result of Sb being concentrated in the surface layer of steel in an annealing process, since it is possible to inhibit a decrease in the amount of B which exists in the surface layer of the steel, it is possible to control the area fraction of a ferrite phase to be within the desired range at a position located at 50 μm in the thickness direction from the surface of a steel sheet. The Sb content is set to be 0.005% or more in order to realize such an effect. On the other hand, when the Sb content is more than 0.015%, such an effect becomes saturated, and there is a decrease in toughness due to the grain-boundary segregation of Sb. Therefore, the Sb content is set to be 0.005% to 0.015%. It is preferable that the lower limit of Sb be 0.008% or more and that the upper limit of the Sb content be 0.012% or less.

Ca: 0.0015% or Less

Since Ca forms oxides elongated in the rolling direction, and since cracking tends to occur at the interface between the oxides and a metallurgical microstructure in a bending test, it is not possible to achieve the desired bendability. It is preferable that the Ca content be as small as possible, and the Ca content is set to be 0.0015% or less. In addition, it is preferable that the Ca content be 0.0007% or less, or more preferably 0.0003% or less, when a higher level of bendability is required.

Cr: 0.01% to 2.00%

Cr is a chemical element which contributes to an increase in strength by increasing the hardenability of steel. The Cr content is set to be 0.01% or more in order to realize such an effect. On the other hand, when the Cr content is more than 2.00%, since there is an excessive increase in strength, it is not possible to achieve the desired bendability. Therefore, the Cr content is set to be 2.00% or less. It is preferable that the Cr content be 0.01% to 1.60%.

Mo: 0.01% to 1.00%

Mo is a chemical element which, like Cr, contributes to an increase in strength by increasing the hardenability of steel. The Mo content is set to be 0.01% or more in order to realize such an effect. On the other hand, when the Mo content is more than 1.00%, since there is an excessive increase in strength, it is not possible to achieve the desired bendability. Therefore, the Mo content is set to be 1.00% or less. It is preferable that the Mo content be 0.01% to 0.60%.

Ni: 0.01% to 5.00%

Since Ni is a chemical element which contributes to an increase in the strength of steel, Ni is added in order to increase the strength of steel. The Ni content is set to be 0.01% or more in order to realize such an effect. On the other hand, when the Ni content is more than 5.00%, since there is an excessive increase in strength, it is not possible to achieve the desired bendability. Therefore, the Ni content is set to be 5.00% or less. It is preferable that the Ni content be 0.01% to 1.00%.

Cu: 0.01% to 5.00%

Since Cu is, like Ni, a chemical element which contributes to an increase in the strength of steel, Cu is added in order to increase the strength of steel. The Cu content is set to be 0.01% or more in order to realize such an effect. On the other hand, when the Cu content is more than 5.00%, since there is an excessive increase in strength, it is not possible to achieve the desired bendability. Therefore, the Cu content is set to be 5.00% or less. It is preferable that the Cu content be 0.01% to 1.00%.

The remainder is Fe and inevitable impurities.

Although the constituent chemical composition described above are the basic constituent chemical composition, at least one selected from V and REM may be added in addition to the basic constituent chemical elements described above in certain embodiments the present invention.

At least one selected from V: 0.005% to 0.100% and REM: 0.0010% to 0.0050%

V may be added in order to increase strength by increasing the hardenability of steel. The lower limit of the V content is the minimum content with which the desired effect is realized, and the upper limit of the V content is the content with which the effect becomes saturated. REM may be added in order to increase bendability by spheroidizing the shape of sulfides. The lower limit of the REM content is the minimum content with which the desired effect is realized, and the upper limit of the REM content is the content with which the effect becomes saturated. Therefore, when V and/or REM are added, the V content is set to be 0.005% to 0.100%, or preferably 0.005% to 0.050%, and the REM content is set to be 0.0010% to 0.0050%.

Hereafter, the reasons for the limitations on the metallurgical microstructure of the high-strength cold-rolled steel sheet having a tensile strength of 980 MPa or more according to certain embodiments of the present invention will be described. First, the metallurgical microstructure at a position located at ¼ of the thickness from the surface of a steel sheet will be described.

Area Fraction of Ferrite Phase: 30% or More

In order to achieve satisfactory ductility, it is necessary that the area fraction of a ferrite phase be 30% or more, or preferably 35% or more. On the other hand, in order to achieve a tensile strength of 980 MPa or more, it is preferable that the area fraction of a ferrite phase be 60% or less, or more preferably 55% or less. Here, in embodiments the present invention, the meaning of the term "a ferrite phase" includes a non-recrystallized ferrite phase. In the case where a non-recrystallized ferrite phase is included, it is preferable that the area fraction of a non-recrystallized ferrite phase be 10% or less.

Area Fraction of at Least One Selected from Bainite Phase and Martensite Phase: 40% to 65%

In order to achieve satisfactory strength, it is necessary that the area fraction of at least one selected from a bainite phase and a martensite phase be 40% or more. On the other hand, in the case where the area fraction of at least one selected from a bainite phase and a martensite phase is more than 65%, since there is an excessive increase in strength, it is not possible to achieve the desired bendability. Therefore, the area fraction of at least one selected from these phases is set to be 65% or less. It is preferable that the area fraction of at least one selected from a bainite phase and a martensite phase be 45% to 60%. The meaning of the term "a bainite phase" in embodiments of the present invention includes so-called upper bainite, in which plate-like cementite is precipitated along the interface of lath-type ferrite, and so-called lower bainite, in which cementite is finely dispersed in a lath-type ferrite. The term "a martensite phase" in embodiments of the present invention refers to a martensite phase in which cementite is not precipitated. Here, it is possible to easily distinguish a bainite phase and a martensite phase by using a scanning electron microscope (SEM).

Area Fraction of Cementite: 5% or Less

In order to achieve good bendability, it is necessary that the area fraction of cementite be 5% or less (including 0%). In addition, the term "cementite" in embodiments of the present invention refers to cementite which separately exists without being included in any metallurgical microstructure.

Here, besides a ferrite phase, a bainite phase, a martensite phase, and cementite, for example, a retained austenite phase may be included in the metallurgical microstructure. In this case, it is preferable that the area fraction of, for example, a retained austenite phase be 5% or less in the metallurgical microstructure.

It is possible to determine the metallurgical microstructure described above by using the methods described in EXAMPLES below.

Area fraction of ferrite phase at position located at 50 μm in thickness direction from surface of steel sheet: 40% to 55%

A ferrite phase at a position located at 50 μm in the thickness direction from the surface of, a steel sheet is the most important metallurgical microstructure in embodiments of the present invention. A ferrite phase at a position located at 50 μm in the thickness direction from the surface of a steel sheet plays a role in dispersing strain applied to a steel sheet by performing bending. In order to stably achieve high bendability within a steel sheet by effectively dispersing strain, it is necessary that the area fraction of a ferrite phase at a position located at 50 μm in the thickness direction from the surface of a steel sheet be 40% or more.

Or the other hand, in the case where such an area fraction is more than 55%, since there is an increase in the hardness of a bainite phase and a martensite phase due to an excessively large amount of C being concentrated in these phases, there is an increase in the difference in hardness between a ferrite phase and phases such as a bainite phase and a martensite phase, which makes it impossible to achieve the desired bendability. Therefore, the area fraction of a ferrite phase at a position located at 50 μm in the thickness direction from the surface of a steel sheet is set to be 55% or less. It is preferable that such an area fraction be 45% to 55%.

It is possible to determine the metallurgical microstructure described above by using the methods described in EXAMPLES below.

The tensile strength of the cold-rolled steel sheet according to embodiments of the present invention is set to be 980 MPa or more in order to realize the collision safety and weight reduction of an automobile body at the same time when the steel sheet is used for the automobile body.

It is preferable that the thickness of the cold-rolled steel sheet according to embodiments of the present invention be 0.8 mm or more, or more preferably 1.0 mm or more. On the other hand, it is preferable that the thickness be 2.3 mm or less. In the case where the surface of the cold-rolled steel sheet according to embodiments of the present invention is coated with, for example, a chemical conversion coating film, the term "thickness" refers to the thickness of the base steel sheet which does not include, for example, the coating film with which the surface is coated.

Hereafter, a preferable method for manufacturing a high-strength cold-rolled steel sheet having a tensile strength of 980 MPa or more will be described.

Molten steel having the chemical composition described above is prepared by using a method such as one which uses a converter and then made into a steel material (slab) by using a casting method such as a continuous casting method.

[Hot Rolling Process]

Subsequently, the obtained steel material is subjected to hot rolling, in which heating followed by rolling is performed in order to obtain a hot-rolled steel sheet. At this time, hot rolling is performed with a finishing delivery temperature of the $Ar_3$ transformation temperature (° C.) or more, and coiling is performed at a temperature of 600° C. or lower. Here, in the description of the hot rolling process below, the term "temperature" refers to the surface temperature of a steel sheet.

Finishing Delivery Temperature: $Ar_3$ Transformation Temperature or More

In the case where the finishing delivery temperature is lower than the $Ar_3$ transformation temperature, since a ferrite phase is formed in the surface layer of a steel sheet, and since, for example, there is an increase in the crystal grain diameter of the ferrite phase due to processing strain, a metallurgical microstructure which is inhomogeneous in the thickness direction is formed. Moreover, it is not possible to control the area fraction of a ferrite phase at a position located at 50 μm in the thickness direction from the surface of a steel sheet to be 55% or less in a metallurgical microstructure after cold rolling or annealing has been performed. Therefore, the finishing delivery temperature is set to be the $Ar_3$ transformation temperature or more. Although there is no particular limitation on the upper limit of the finishing delivery temperature, in the case where rolling is performed at an excessively high temperature, for example, a scale flaw occurs. Therefore, it is preferable that the finishing delivery temperature be 1000° C. or lower.

Here, it is possible to calculate the $Ar_3$ transformation temperature by using equation (1) below.

$$Ar_3=910-310\times[C]-80\times[Mn]-20\times[Cu]-15\times[Cr]-55\times[Ni]-80\times[Mo]+0.35\times(t-0.8) \quad (1)$$

Here, under the assumption that symbol M is used instead of the atomic symbol of some chemical element, symbol [M] denotes the content (mass %) of the chemical element denoted by symbol M, and t denotes thickness (mm).

Coiling Temperature: 600° C. or Lower

In the case where the coiling temperature is higher than 600° C., since the metallurgical microstructure of a hot-rolled steel sheet after hot rolling has been performed includes a ferrite phase and a pearlite phase, the metallurgical microstructure of a steel sheet after annealing following cold rolling has been performed includes cementite in an amount of more than 5% in terms of area fraction, which makes it impossible to achieve the desired bendability. Therefore, the coiling temperature is set to be 600° C. or lower. Here, it is preferable that the coiling temperature be 200° C. or higher in order to prevent a deterioration in the shape of a hot-rolled steel sheet.

[Pickling Process and Cold Rolling Process]

Subsequently, pickling and cold rolling are performed.

In the pickling process, black scale, which has been generated on the surface of a steel sheet, is removed. Here, there is no particular limitation on the conditions used for pickling.

Rolling Reduction of Cold Rolling: 40% or More (Preferable Condition)

In the case where the rolling reduction of cold rolling is less than 40%, since the recrystallization of a ferrite phase is less likely to progress, a non-recrystallized ferrite phase is retained in the metallurgical microstructure after annealing has been performed, which may result in a decrease in bendability. Therefore, it is preferable that the rolling reduction of cold rolling be 40% or more.

[Annealing Process]

Subsequently, annealing is performed. This process includes a process in which heating is performed to a first heating temperature of 600° C. or lower at an average heating rate of 0.15° C./min or less, a process in which holding is performed at an annealing temperature of 700° C. to $(Ac_3-5)$° C. for 5 hours to 50 hours, and a process in which cooling is performed to a first cooling temperature of 620° C. or higher at an average cooling rate of 1.2° C./min or more. Here, in the description of the annealing process below, the term "temperature" refers to the temperature of a steel sheet.

Heating to a First Heating Temperature of 600° C. or Lower at an Average Heating Rate of 0.15° C./Min or Less In the case where the average heating rate is more than 0.15° C./min, since the area fraction of a ferrite phase at a position located at 50 μm in the thickness direction from the surface of a steel sheet becomes less than 40% in a steel sheet after annealing has been performed, it is not possible to achieve the desired bendability. In the case where the average heating rate is less than 0.10° C./min, since it is necessary that the length of the furnace be longer than usual, there is an increase in energy consumption, which results in an increase in cost and a decrease in productivity. Therefore, it is preferable that the average heating rate be 0.10° C./min or more. Here, in the case where the first heating temperature is higher than 600° C., since there is an excessive increase in the area fraction of a ferrite phase at a position located at 50 μm in the thickness direction from the surface of a steel sheet, it is not possible to achieve the desired bendability.

Therefore, the first heating temperature is set to be 600° C. or lower. On the other hand, it is preferable that the first heating temperature be 550° C. or higher in order to stably control the area fraction of a ferrite phase at a position located at 50 μm in the thickness direction from the surface layer of a steel sheet to be 40% or more.

Holding at an Annealing Temperature of 700° C. to ($Ac_3$−5)° C. For 5 Hours to 50 Hours After control heating has been performed as described above, heating is further performed to the annealing temperature. In the case where the annealing (holding) temperature is lower than 700° C. or the annealing (holding) time is less than 5 hours, since there is an insufficient amount of austenite layer formed due to cementite which has been formed in the hot rolling process being not sufficiently dissolved in the annealing process, there are insufficient amounts of bainite phase and martensite phase formed when cooling is performed in the annealing process, which results in insufficient strength. Moreover, since the area fraction of cementite becomes more than 5%, it is not possible to achieve the desired bendability. On the other hand, in the case where the annealing (holding) temperature is higher than ($Ac_3$−5)° C., since the grain growth of an austenite phase is significant, there is an excessive increase in strength due to the area fraction of a ferrite phase at a position located at ¼ of the thickness from the surface of a steel sheet after annealing has been performed becoming less than 30%, which makes it impossible to achieve the desired bendability. In the case where the annealing (holding) time is more than 50 hours, since the area fraction of a ferrite phase at a position located at 50 μm in the thickness direction from the surface of a steel sheet becomes more than 55% after annealing has been performed, there is a decrease in bendability. Here, it is possible to calculate the $Ac_3$ transformation temperature (° C.) by using equation (2) below.

$$Ac_3=910-203\times[C]^{1/2}-15.2\times[Ni]+44.7\times[Si]+104\times[V]+31.5\times[Mo]+13.1\times[W]-30\times[Mn]-11\times[Cr]-20\times[Cu]+700\times[P]+400\times[Al]+120\times[As]+400\times[Ti] \quad (2)$$

Here, under the assumption that symbol M is used instead of the atomic symbol of some chemical element, symbol [M] denotes the content (mass %) of the chemical element denoted by symbol M, and the content of a chemical element which is not added is set to be 0.

Cooling to a First Cooling Temperature of 620° C. or Higher at an Average Cooling Rate of 1.2° C./Min or More The average cooling rate in this temperature range (from the annealing temperature to the first cooling temperature) relates to one of the important requirements in embodiments of the present invention. In the case where the average cooling rate is less than 1.2° C./min, since an excessive amount of ferrite phase is precipitated in the surface layer region of a steel sheet during cooling, the area fraction of a ferrite phase at a position located at 50 μm in the thickness direction from the surface of a steel sheet becomes more than 55%, which makes it impossible to achieve the desired bendability. It is preferable that the average cooling rate be 1.4° C./min or more. Although there is no particular limitation on the upper limit of the average cooling rate, in the case where the average cooling rate is more than 1.7° C./min, the effect becomes saturated. Therefore, it is preferable that the average cooling rate be 1.7° C./min or less. In the case where the first cooling temperature is lower than 620° C., since an excessive amount of ferrite phase is precipitated in the surface layer region of a steel sheet during cooling, the area fraction of a ferrite phase at a position located at 50 μm in the thickness direction from the surface of a steel sheet becomes more than 55%, which makes it impossible to achieve the desired bendability. Therefore, the first cooling temperature is set to be 620° C. or higher. It is preferable that the first cooling temperature be 640° C. or higher. On the other hand, it is preferable that the first cooling temperature be 680° C. or lower in order to stably control the area fraction of a ferrite phase at a position located at 50 μm in the thickness direction from the surface layer of a steel sheet to be 40% or more.

It is possible to obtain the high-strength cold-rolled steel sheet having a tensile strength of 980 MPa or more according to embodiments of the present invention by using the manufacturing method including the processes described above.

Here, in the annealing treatment in the manufacturing method according to embodiments of the present invention, it is not necessary that the holding temperature be constant as long as the holding temperature is within the range described above, and there is no problem even in the case where the cooling rate varies during cooling as long as the average cooling rate is within the specified range. In addition, even in the case where any kind of equipment is used for the heat treatments, the purport of embodiments of the present invention is maintained as long as the requirements regarding the thermal histories are satisfied. In addition, temper rolling may be performed for the purpose of shape correction. It is preferable that temper rolling be performed with an elongation ratio of 0.3% or less.

In certain embodiments of the present invention, it is assumed that a steel sheet is manufactured through commonly used steel-making process, casting process, hot rolling process, pickling process, cold rolling process, and annealing process. However, a case where a steel sheet which is manufactured through a process in which, for example, all or part of a hot rolling process is omitted by using a thin-slab casting method has the chemical composition, metallurgical microstructure, and the tensile strength according to embodiments of the present invention is also within the range according to embodiments of the present invention.

Moreover, in embodiments of the present invention, even in the case where the obtained high-strength cold-rolled steel sheet is subjected to various surface treatments such as a chemical conversion treatment, there is no decrease in the effects of the present invention.

EXAMPLES

Hereafter, the present invention will be specifically described on the basis of examples. The technical scope of the present invention is not limited to the examples described below.

Steel materials (slabs) having the chemical compositions given in Table 1 (the balance being Fe and inevitable impurities) were used as starting materials. These steel materials were subjected to heating to the heating temperature given in Table 2 and Table 3, hot rolling, pickling, cold rolling (with a rolling reduction of 42% to 53%), and annealing under the conditions given in Table 2 and Table 3. Here, the thicknesses given in Table 2 and Table 3 were maintained even after the annealing treatment had been performed.

Microstructure observation and the evaluation of tensile properties and bendability were performed on the cold-rolled steel sheets obtained as described above. The determination methods will be described below.

(1) Microstructure Observation

Regarding a metallurgical microstructure, the area fraction of each of the phases was derived by polishing the cross section in the thickness direction parallel to the rolling direction of the steel sheet, by then etching the polished cross section by using a 3%-nital solution, by then observing 10 fields of view at a position located at ¼ of the thickness from the surface of the steel sheet through the use of a scanning electron microscope (SEM) at a magnification of 2000 times, and by then analyzing the observed images by performing image analysis using image analysis software "Image-Pro Plus ver. 4.0" manufactured by Media Cybernetics, Inc. That is, the area fraction of each of a ferrite phase, a bainite phase, a martensite phase, and cementite was derived in each of the observation fields of view by distinguishing each of the phases on the digital image through image analysis and by performing image processing. The area fraction of each of the phases was derived by calculating the average value of the area fractions of these 10 fields of view.

Area Fraction of Ferrite Phase at Position Located at 50 μm in Thickness Direction from Surface of Steel Sheet The area fraction of a ferrite phase was determined by polishing the surface layer parallel to the rolling direction of a steel sheet, by then etching the polished surface by using a 3%-nital solution, by then observing 10 fields of view at a position located at 50 μm in the thickness direction from the surface of the steel sheet through the use of a scanning electron microscope (SEM) at a magnification of 2000 times, and by then analyzing the observed images through the use of image analysis software "Image-Pro Plus ver. 4.0" manufactured by Media Cybernetics, Inc. That is, the area fraction of a ferrite phase in each of the observation fields of view was determined by distinguishing a ferrite phase on the digital image through image analysis and by performing image processing. The area fraction of a ferrite phase at a position located at 50 μm from the surface layer was derived by calculating the average value of the area fractions of these 10 fields of view.

(2) Tensile Properties

A tensile test (JIS Z 2241 (2011)) was performed on a JIS No. 5 tensile test piece which had been taken from the obtained steel sheets in a direction at a right angle to the rolling direction of the steel sheet. By performing the tensile test until breaking occurred, tensile strength (TS) and ductility (breaking elongation: El) were determined. A case of a tensile strength of 980 MPa or more was judged as a case of satisfactory tensile strength. In addition, a case of a product of tensile strength (TS) and ductility (El) of 12500 MPa·% or more, or preferably 13000 MPa·% or more, was judged as a case of good strength-ductility balance.

(3) Bendability

Bendability was evaluated on the basis of a V-block method prescribed in JIS Z 2248. Three evaluation samples were taken at each of 5 positions arranged in the width (W) direction of the steel sheet, that is, at ⅛ of W, ¼ of W, ½ of W (central position in the width direction of the steel sheet), ¾ of W, and ⅞ of W. In a bending test, by checking whether or not a crack occurred on the outer side of the bending position through a visual test, the minimum bending radius with which a crack did not occur was defined as a limit bending radius. In embodiments of the present invention, the average value of the limit bending radii of the 5 positions was defined as the limit bending radius of the steel sheet. In Table 2 and Table 3, the ratio of the limit bending radius to the thickness (R/t) is given. In embodiments of the present invention, a case of an R/t was 2.5 or less was judges as good.

The obtained results as described above are given along with the conditions in Table 2 and Table 3.

TABLE 1

| Steel | Chemical Composition (mass %) | | | | | | | | | | | | |
|---|---|---|---|---|---|---|---|---|---|---|---|---|---|
| No. | C | Si | Mn | P | S | Al | N | Cr | V | Sb | Mo | Cu | Ni |
| A | 0.082 | 0.63 | 2.61 | 0.019 | 0.0015 | 0.037 | 0.0039 | 0.64 | — | 0.009 | 0.35 | 0.02 | 0.06 |
| B | 0.071 | 0.56 | 2.76 | 0.018 | 0.0013 | 0.043 | 0.0036 | 0.62 | — | 0.010 | 0.34 | 0.02 | 0.05 |
| C | 0.083 | 0.68 | 2.62 | 0.017 | 0.0014 | 0.040 | 0.0037 | 0.93 | — | 0.011 | 0.21 | 0.03 | 0.01 |
| D | 0.097 | 0.62 | 2.68 | 0.019 | 0.0010 | 0.042 | 0.0035 | 0.02 | — | 0.007 | 0.56 | 0.03 | 0.02 |
| E | 0.090 | 0.52 | 2.45 | 0.017 | 0.0011 | 0.044 | 0.0039 | 1.43 | — | 0.012 | 0.02 | 0.02 | 0.02 |
| F | 0.080 | 0.64 | 2.61 | 0.019 | 0.0009 | 0.052 | 0.0036 | 0.02 | — | 0.013 | 0.02 | 0.03 | 4.63 |
| G | 0.095 | 0.56 | 2.65 | 0.022 | 0.0016 | 0.058 | 0.0049 | 0.03 | 0.095 | 0.014 | 0.02 | 4.61 | 0.02 |
| H | 0.084 | 0.61 | 2.62 | 0.019 | 0.0013 | 0.057 | 0.0042 | 0.81 | — | 0.012 | 0.23 | 0.15 | 0.14 |
| I | 0.086 | 0.57 | 2.59 | 0.021 | 0.0012 | 0.051 | 0.0043 | 0.59 | — | 0.015 | 0.31 | 0.01 | 0.01 |
| J | 0.088 | 0.59 | 2.63 | 0.016 | 0.0013 | 0.045 | 0.0040 | 0.18 | — | 0.009 | 0.45 | 0.02 | 0.02 |
| K | 0.089 | 0.60 | 2.66 | 0.021 | 0.0017 | 0.022 | 0.0048 | 0.76 | — | 0.013 | 0.29 | 0.14 | 0.16 |
| L | 0.081 | 0.55 | 2.54 | 0.018 | 0.0019 | 0.046 | 0.0031 | 0.85 | — | 0.006 | 0.22 | 0.01 | 0.37 |
| M | 0.094 | 0.62 | 2.47 | 0.019 | 0.0011 | 0.039 | 0.0042 | 1.03 | 0.076 | 0.008 | 0.11 | 0.02 | 0.65 |
| N | 0.083 | 0.64 | 2.65 | 0.015 | 0.0010 | 0.043 | 0.0039 | 0.57 | — | 0.010 | 0.28 | 0.01 | 0.09 |
| a | 0.088 | 0.58 | 2.57 | 0.022 | 0.0031 | 0.041 | 0.0038 | 0.78 | — | 0.009 | 0.23 | 0.01 | 0.34 |
| b | 0.137 | 0.61 | 2.60 | 0.018 | 0.0012 | 0.038 | 0.0039 | 0.21 | — | 0.010 | 0.46 | 0.02 | 0.02 |
| c | 0.082 | 0.62 | 2.55 | 0.022 | 0.0017 | 0.044 | 0.0042 | 1.04 | — | 0.004 | 0.09 | 0.02 | 0.62 |
| d | 0.036 | 0.59 | 2.64 | 0.019 | 0.0014 | 0.040 | 0.0036 | 0.76 | — | 0.011 | 0.22 | 0.14 | 0.17 |
| e | 0.085 | 0.53 | 2.53 | 0.033 | 0.0010 | 0.042 | 0.0041 | 0.93 | — | 0.002 | 0.21 | 0.02 | 0.01 |
| f | 0.083 | 0.67 | 2.61 | 0.019 | 0.0015 | 0.047 | 0.0037 | 0.02 | 0.117 | 0.001 | 0.48 | 0.02 | 0.01 |
| g | 0.071 | 0.55 | 2.59 | 0.017 | 0.0008 | 0.039 | 0.0043 | 0.62 | — | 0.004 | 0.29 | 0.01 | 0.08 |
| h | 0.077 | 0.54 | 2.58 | 0.018 | 0.0016 | 0.036 | 0.0038 | 1.47 | — | 0.002 | 0.01 | 0.02 | 0.02 |
| i | 0.082 | 0.05 | 2.62 | 0.021 | 0.0011 | 0.043 | 0.0035 | 0.72 | — | 0.006 | 0.27 | 0.01 | 0.02 |
| j | 0.094 | 0.56 | 2.56 | 0.020 | 0.0013 | 0.045 | 0.0044 | 0.61 | — | 0.005 | 0.32 | 0.01 | 0.07 |

TABLE 1-continued

| Steel No. | Chemical Composition (mass %) Ti | Nb | B | Ca | REM | $Ar_3$ Transformation Temperature (° C.) | $Ac_3$ Transformation Temperature (° C.) | Note |
|---|---|---|---|---|---|---|---|---|
| A | 0.017 | 0.040 | 0.0013 | 0.0001 | — | 635 | 840 | Example |
| B | 0.015 | 0.045 | 0.0014 | 0.0001 | — | 628 | 837 | Example |
| C | 0.018 | 0.042 | 0.0012 | 0.0002 | — | 643 | 834 | Example |
| D | 0.013 | 0.038 | 0.0014 | 0.0001 | — | 619 | 846 | Example |
| E | 0.013 | 0.036 | 0.0011 | 0.0002 | — | 662 | 818 | Example |
| F | 0.016 | 0.039 | 0.0007 | 0.0010 | — | 419 | 773 | Example |
| G | 0.014 | 0.044 | 0.0027 | 0.0002 | — | 573 | 755 | Example |
| H | 0.016 | 0.037 | 0.0008 | 0.0001 | — | 633 | 836 | Example |
| I | 0.012 | 0.059 | 0.0006 | 0.0008 | — | 642 | 841 | Example |
| J | 0.029 | 0.012 | 0.0015 | 0.0005 | — | 632 | 850 | Example |
| K | 0.021 | 0.043 | 0.0010 | 0.0011 | — | 624 | 824 | Example |
| L | 0.018 | 0.031 | 0.0015 | 0.0007 | — | 631 | 831 | Example |
| M | 0.021 | 0.029 | 0.0014 | 0.0013 | 0.0020 | 623 | 828 | Example |
| N | 0.016 | 0.042 | 0.0012 | 0.0002 | — | 636 | 836 | Example |
| a | 0.013 | 0.038 | 0.0016 | 0.0002 | — | 628 | 829 | Comparative Example |
| b | 0.016 | 0.040 | 0.0014 | 0.0003 | — | 618 | 830 | Comparative Example |
| c | 0.014 | 0.036 | 0.0013 | 0.0002 | — | 623 | 823 | Comparative Example |
| d | 0.019 | 0.044 | 0.0010 | 0.0002 | — | 647 | 849 | Comparative Example |
| e | 0.011 | 0.030 | 0.0022 | 0.0003 | — | 650 | 839 | Comparative Example |
| f | 0.028 | 0.026 | 0.0008 | 0.0013 | — | 636 | 873 | Comparative Example |
| g | 0.014 | 0.039 | 0.0014 | 0.0009 | — | 644 | 837 | Comparative Example |
| h | 0.025 | 0.047 | 0.0015 | 0.0014 | — | 656 | 821 | Comparative Example |
| i | 0.027 | 0.052 | 0.0017 | 0.0012 | — | 641 | 818 | Comparative Example |
| j | 0.018 | 0.019 | 0.0003 | 0.0010 | — | 637 | 838 | Comparative Example |

Underlined portion: out of the range according to the present invention

TABLE 2

| Steel Sheet No. | Steel No. | Hot Rolling Condition: Heating Temperature (° C.) | Finishing Delivery Temperature (° C.) | Coiling Temperature (° C.) | Cold Rolling: Condition Cold Rolling Reduction (%) | Annealing Condition: Thickness (mm) | Average Heating Rate to First Heating Temperature (° C./min) | First Heating Temperature (° C.) |
|---|---|---|---|---|---|---|---|---|
| 1 | A | 1240 | 860 | 560 | 46 | 1.4 | 0.11 | 580 |
| 2 | B | 1240 | 860 | 560 | 46 | 1.4 | 0.12 | 560 |
| 3 | C | 1240 | 860 | 560 | 42 | 1.4 | 0.12 | 570 |
| 4 | D | 1240 | 860 | 560 | 42 | 1.4 | 0.13 | 550 |
| 5 | E | 1240 | 860 | 560 | 44 | 2.0 | 0.15 | 570 |
| 6 | F | 1240 | 860 | 560 | 46 | 1.4 | 0.14 | 590 |
| 7 | G | 1240 | 860 | 560 | 46 | 1.4 | 0.14 | 580 |
| 8 | H | 1240 | 860 | 560 | 42 | 1.4 | 0.14 | 580 |
| 9 | I | 1240 | 860 | 560 | 46 | 1.4 | 0.15 | 580 |
| 10 | J | 1240 | 860 | 560 | 46 | 1.4 | 0.13 | 590 |
| 11 | K | 1240 | 860 | 560 | 46 | 1.4 | 0.14 | 590 |
| 12 | L | 1240 | 860 | 560 | 50 | 1.4 | 0.11 | 580 |
| 13 | M | 1240 | 860 | 560 | 46 | 1.4 | 0.14 | 590 |
| 14 | N | 1240 | 860 | 560 | 46 | 1.4 | 0.12 | 580 |
| 15 | a | 1240 | 860 | 560 | 46 | 1.4 | 0.11 | 570 |
| 16 | b | 1240 | 860 | 560 | 42 | 1.4 | 0.12 | 570 |
| 17 | c | 1240 | 860 | 560 | 42 | 1.4 | 0.14 | 580 |
| 18 | d | 1240 | 860 | 560 | 48 | 1.4 | 0.14 | 580 |
| 19 | e | 1240 | 860 | 560 | 50 | 1.4 | 0.14 | 580 |
| 20 | f | 1240 | 860 | 560 | 42 | 1.4 | 0.12 | 570 |
| 21 | g | 1240 | 860 | 560 | 50 | 1.4 | 0.13 | 570 |

TABLE 2-continued

| | | | | | | | | |
|---|---|---|---|---|---|---|---|---|
| 22 | h | 1240 | 860 | 560 | 46 | 1.4 | 0.13 | 590 |
| 23 | i | 1240 | 860 | 560 | 53 | 1.4 | 0.13 | 590 |
| 24 | j | 1240 | 860 | 560 | 46 | 1.4 | 0.13 | 580 |

| | Annealing Condition | | | | Metallurgical Microstructure | | |
|---|---|---|---|---|---|---|---|
| Steel Sheet No. | Annealing Temperature (° C.) | Annealing (Holding) Time (h) | Average Cooling Rate to First Cooling Temperature (° C./min) | First Cooling Temperature (° C.) | Area fraction of Ferrite at Position Located at ¼ of Thickness from Sheet Surface (%) | Area fraction of Bainite and/or Martensite at Position Located at ¼ of Thickness from Sheet Surface (%) | Area fraction of cementite at Position Located at ¼ of Thickness from Sheet Surface (%) |
| 1 | 820 | 20 | 1.4 | 660 | 43 | 53 | 4 |
| 2 | 820 | 13 | 1.4 | 640 | 41 | 55 | 2 |
| 3 | 810 | 18 | 1.5 | 670 | 43 | 55 | 2 |
| 4 | 830 | 15 | 1.6 | 650 | 39 | 60 | 1 |
| 5 | 800 | 24 | 1.2 | 650 | 41 | 55 | 4 |
| 6 | 750 | 21 | 1.4 | 620 | 39 | 57 | 4 |
| 7 | 730 | 42 | 1.7 | 640 | 35 | 62 | 3 |
| 8 | 820 | 26 | 1.4 | 630 | 44 | 53 | 3 |
| 9 | 820 | 47 | 1.6 | 650 | 37 | 61 | 2 |
| 10 | 840 | 29 | 1.5 | 640 | 42 | 56 | 2 |
| 11 | 800 | 34 | 1.5 | 640 | 40 | 57 | 3 |
| 12 | 810 | 19 | 1.6 | 630 | 46 | 53 | 1 |
| 13 | 800 | 28 | 1.3 | 650 | 33 | 64 | 3 |
| 14 | 820 | 25 | 1.5 | 640 | 38 | 58 | 4 |
| 15 | 820 | 12 | 1.2 | 650 | 31 | 64 | 5 |
| 16 | 820 | 29 | 1.6 | 650 | 28 | 58 | 11 |
| 17 | 810 | 18 | 1.5 | 620 | 45 | 52 | 3 |
| 18 | 840 | 7 | 1.4 | 640 | 67 | 24 | 9 |
| 19 | 830 | 31 | 1.3 | 630 | 36 | 62 | 2 |
| 20 | 850 | 43 | 1.6 | 680 | 43 | 56 | 1 |
| 21 | 820 | 27 | 1.5 | 630 | 41 | 57 | 2 |
| 22 | 800 | 36 | 1.7 | 690 | 37 | 59 | 4 |
| 23 | 800 | 28 | 1.4 | 640 | 34 | 63 | 3 |
| 24 | 820 | 14 | 1.4 | 630 | 49 | 48 | 3 |

| | Metallurgical Microstructure | | Property | | | | |
|---|---|---|---|---|---|---|---|
| Steel Sheet No. | Area fraction of Ferrite at Position Located at 50 μm from Sheet Surface (%) | Remainder of Metallurgical Microstructure at Position Located at ¼ of Thickness from Sheet Surface | Tensile Strength (MPa) | Ductility (%) | Strength-Ductility Balance (MPa · %) | R/t | Note |
| 1 | 52 | — | 1064 | 12.4 | 13194 | 1.4 | Example |
| 2 | 50 | Retained Austenite | 987 | 13.5 | 13325 | 1.1 | Example |
| 3 | 53 | — | 1036 | 12.7 | 13157 | 1.3 | Example |
| 4 | 51 | — | 1125 | 11.9 | 13388 | 1.2 | Example |
| 5 | 42 | — | 1112 | 11.5 | 12788 | 1.1 | Example |
| 6 | 43 | — | 1053 | 12.3 | 12952 | 1.0 | Example |
| 7 | 41 | — | 1128 | 11.4 | 12859 | 1.4 | Example |
| 8 | 53 | — | 1081 | 12.1 | 13080 | 1.2 | Example |
| 9 | 44 | — | 1147 | 11.0 | 12617 | 1.3 | Example |
| 10 | 53 | — | 1098 | 11.9 | 13066 | 1.1 | Example |
| 11 | 43 | — | 1129 | 11.3 | 12758 | 1.1 | Example |
| 12 | 51 | — | 1043 | 12.6 | 13142 | 1.2 | Example |
| 13 | 44 | — | 1067 | 12.0 | 12804 | 1.1 | Example |
| 14 | 52 | — | 1052 | 12.5 | 13150 | 1.1 | Example |
| 15 | 49 | — | 1041 | 12.7 | 13221 | 3.3 | Comparative Example |
| 16 | 52 | Retained Austenite | 1163 | 10.4 | 12095 | 3.4 | Comparative Example |
| 17 | 67 | — | 1057 | 11.6 | 12261 | 2.7 | Comparative Example |
| 18 | 54 | — | 784 | 15.8 | 12387 | 1.4 | Comparative Example |
| 19 | 64 | — | 1062 | 11.5 | 12213 | 2.9 | Comparative Example |
| 20 | 68 | — | 1025 | 12.1 | 12403 | 3.1 | Comparative Example |

TABLE 2-continued

| | | | | | | | |
|---|---|---|---|---|---|---|---|
| 21 | 66 | — | 1049 | 11.9 | 12483 | 2.9 | Comparative Example |
| 22 | 69 | — | 1032 | 12.0 | 12384 | 3.3 | Comparative Example |
| 23 | 72 | — | 1026 | 11.7 | 12004 | 3.0 | Comparative Example |
| 24 | 63 | — | 1068 | 11.2 | 11962 | 3.1 | Comparative Example |

Underlined portion: out of the range according to the present invention

TABLE 3

| | | Hot Rolling Condition | | | Cold Rolling | Continuous Annealing Condition | | |
|---|---|---|---|---|---|---|---|---|
| Steel Sheet No. | Steel No. | Heating Temperature (° C.) | Finishing Delivery Temperature (° C.) | Coiling Temperature (° C.) | Condition Cold Rolling Reduction (%) | Thickness (mm) | Average Heating Rate to First Heating Temperature (° C./min) | First Heating Temperature (° C.) |
| 25 | A | 1230 | 600 | 550 | 42 | 1.4 | 0.11 | 580 |
| 26 | A | 1230 | 850 | 740 | 42 | 1.4 | 0.15 | 590 |
| 27 | A | 1220 | 830 | 560 | 42 | 1.4 | 0.13 | 710 |
| 28 | A | 1230 | 860 | 540 | 42 | 1.4 | 0.12 | 580 |
| 29 | A | 1240 | 840 | 580 | 42 | 1.4 | 0.13 | 570 |
| 30 | A | 1220 | 870 | 550 | 42 | 1.4 | 0.11 | 580 |
| 31 | A | 1230 | 850 | 550 | 46 | 1.4 | 0.14 | 550 |
| 32 | A | 1240 | 820 | 560 | 46 | 1.4 | 0.14 | 560 |
| 33 | A | 1240 | 860 | 540 | 46 | 1.4 | 0.11 | 580 |
| 34 | A | 1220 | 840 | 560 | 42 | 1.4 | 0.12 | 560 |
| 35 | A | 1220 | 850 | 570 | 46 | 1.4 | 0.13 | 570 |
| 36 | A | 1230 | 850 | 560 | 42 | 1.4 | 0.12 | 580 |
| 37 | A | 1230 | 870 | 550 | 42 | 1.4 | 0.14 | 590 |
| 38 | H | 1230 | 840 | 550 | 42 | 1.4 | 0.15 | 580 |
| 39 | H | 1230 | 870 | 560 | 46 | 1.4 | 0.13 | 580 |
| 40 | H | 1240 | 830 | 570 | 46 | 1.4 | 0.11 | 590 |
| 41 | H | 1240 | 850 | 560 | 46 | 1.4 | 0.13 | 580 |
| 42 | H | 1230 | 850 | 560 | 46 | 1.4 | 0.21 | 570 |
| 43 | H | 1230 | 860 | 580 | 46 | 1.4 | 0.14 | 590 |
| 44 | H | 1240 | 850 | 550 | 42 | 1.4 | 0.13 | 580 |
| 45 | H | 1220 | 850 | 540 | 42 | 1.4 | 0.10 | 590 |
| 46 | a | 1240 | 860 | 560 | 42 | 1.4 | 0.12 | 580 |
| 47 | a | 1230 | 870 | 550 | 42 | 1.4 | 0.14 | 570 |

| | Continuous Annealing Condition | | | | Metallurgical Microstructure | | |
|---|---|---|---|---|---|---|---|
| Steel Sheet No. | Annealing Temperature (° C.) | Annealing (Holding) Time (h) | Average Cooling Rate to First Cooling Temperature (° C./min) | First Cooling Temperature (° C.) | Area fraction of Ferrite at Position Located at ¼ of Thickness from Sheet Surface (%) | Area fraction of Bainite and/or Martensite at Position Located at ¼ of Thickness from Sheet Surface (%) | Area fraction of cementite at Position Located at ¼ of Thickness from Sheet Surface (%) |
| 25 | 820 | 22 | 1.4 | 650 | 49 | 47 | 4 |
| 26 | 810 | 34 | 1.2 | 660 | 47 | 42 | 11 |
| 27 | 810 | 21 | 1.6 | 640 | 38 | 55 | 7 |
| 28 | 790 | 19 | 1.3 | 670 | 46 | 51 | 3 |
| 29 | 800 | 12 | 1.7 | 650 | 43 | 56 | 1 |
| 30 | 900 | 18 | 1.5 | 620 | 27 | 63 | 10 |
| 31 | 820 | 23 | 1.7 | 680 | 45 | 54 | 1 |
| 32 | 800 | 19 | 1.6 | 660 | 39 | 59 | 2 |
| 33 | 820 | 38 | 1.4 | 660 | 42 | 54 | 4 |
| 34 | 770 | 3 | 1.3 | 650 | 47 | 36 | 17 |
| 35 | 820 | 19 | 1.2 | 670 | 44 | 54 | 2 |
| 36 | 810 | 17 | 0.6 | 650 | 52 | 46 | 2 |
| 37 | 910 | 25 | 1.4 | 630 | 25 | 61 | 14 |
| 38 | 800 | 31 | 1.2 | 600 | 46 | 51 | 3 |
| 39 | 810 | 26 | 1.4 | 650 | 39 | 59 | 2 |
| 40 | 790 | 24 | 1.2 | 620 | 42 | 53 | 1 |

TABLE 3-continued

| | | | | | | | |
|---|---|---|---|---|---|---|---|
| 41 | 820 | 19 | 1.5 | 630 | 47 | 51 | 2 |
| 42 | 810 | 45 | 1.4 | 640 | 46 | 50 | 4 |
| 43 | 800 | 16 | 1.6 | 640 | 43 | 55 | 2 |
| 44 | 630 | 27 | 1.3 | 610 | 42 | 34 | 24 |
| 45 | 820 | 150 | 1.6 | 630 | 54 | 42 | 4 |
| 46 | 820 | 27 | 1.0 | 650 | 48 | 49 | 3 |
| 47 | 800 | 18 | 1.5 | 550 | 46 | 52 | 2 |

| | Metallurgical Microstructure | | Property | | | | |
|---|---|---|---|---|---|---|---|
| | Area fraction of Ferrite at Position | Remainder of Metallurgical Microstructure at Position | | | | | |
| Steel Sheet No. | Located at 50 μm from I Sheet Surface (%) | Located at ¼ of Thickness from Sheet Surface | Tensile Strength (MPa) | Ductility (%) | Strength-Ductility Balance (MPa · %) | R/t | Note |
| 25 | 65 | — | 1046 | 11.8 | 12343 | 2.8 | Comparative Example |
| 26 | 42 | — | 1053 | 10.2 | 10741 | 3.1 | Comparative Example |
| 27 | 66 | — | 1098 | 11.0 | 12078 | 2.9 | Comparative Example |
| 28 | 47 | — | 1032 | 12.9 | 13313 | 1.2 | Example |
| 29 | 43 | — | 1137 | 11.4 | 12962 | 1.4 | Example |
| 30 | 33 | — | 1204 | 8.7 | 10475 | 2.8 | Comparative Example |
| 31 | 45 | — | 1081 | 12.3 | 13296 | 1.1 | Example |
| 32 | 43 | — | 1143 | 11.2 | 12802 | 0.9 | Example |
| 33 | 47 | — | 1086 | 11.6 | 12598 | 1.1 | Example |
| 34 | 44 | — | 907 | 11.8 | 10703 | 3.0 | Comparative Example |
| 35 | 49 | — | 1059 | 12.1 | 12814 | 1.3 | Example |
| 36 | 64 | — | 1016 | 11.8 | 11989 | 2.6 | Comparative Example |
| 37 | 31 | — | 1243 | 8.6 | 10690 | 3.1 | Comparative Example |
| 38 | 59 | — | 1028 | 12.0 | 12336 | 3.0 | Comparative Example |
| 39 | 45 | — | 1114 | 11.7 | 13034 | 1.3 | Example |
| 40 | 54 | Retained Austenite | 1090 | 11.9 | 12971 | 1.4 | Example |
| 41 | 46 | — | 1057 | 12.4 | 13107 | 1.1 | Example |
| 42 | 35 | — | 993 | 12.1 | 12015 | 3.0 | Comparative Example |
| 43 | 42 | — | 1069 | 12.3 | 13149 | 0.9 | Example |
| 44 | 43 | — | 941 | 10.7 | 10069 | 3.3 | Comparative Example |
| 45 | 61 | — | 992 | 12.3 | 12202 | 2.7 | Comparative Example |
| 46 | 58 | — | 1027 | 11.6 | 11913 | 2.9 | Comparative Example |
| 47 | 64 | — | 1044 | 11.4 | 11902 | 3.1 | Comparative Example |

Underlined portion: out of the range according to the present invention

As Table 2 and Table 3 indicate, it is clarified that tensile strength, strength-ductility balance and bendability were good in the case of the examples of the present invention which had a metallurgical microstructure including a ferrite phase in an amount of 30% or more in terms of area fraction, a bainite phase and/or a martensite phase in an amount of 40% to 65% in total in terms of area fraction, and a cementite in an amount of 5% or less in terms of area fraction at a position located at ¼ of the thickness from the surface of the steel sheet and a metallurgical microstructure including a ferrite phase in an amount of 40% to 55% in terms of area fraction at a position located at 50 μm in the thickness direction from the surface of the steel sheet.

On the other hand, one or more of strength, strength-ductility balance, and bendability were low in the case of the comparative examples. In particular, it is clarified that bendability was not improved even though the metallurgical microstructure was optimized in the case of the comparative example (steel sheet No. 15) which had an inappropriate chemical composition.

The invention claimed is:

1. A high-strength, cold-rolled steel sheet having a tensile strength of 980 MPa or more, the steel sheet having a chemical composition containing, by mass %, C: 0.070% to 0.100%, Si: 0.50% to 0.70%, Mn: 2.40% to 2.80%, P: 0.025% or less, S: 0.0020% or less, Al: 0.020% to 0.060%, N: 0.0050% or less, Nb: 0.010% to 0.060%, Ti: 0.010% to 0.030%, B: 0.0005% to 0.0030%, Sb: 0.005% to 0.015%, Ca: 0.0015% or less, Cr: 0.01% to 2.00%, Mo: 0.01% to 1.00%, Ni: 0.01% to 5.00%, Cu: 0.01% to 5.00%, and the balance being Fe and inevitable impurities, a metallurgical microstructure including a ferrite phase in an amount of 30% or more in terms of area fraction, at least one selected from a bainite phase and a martensite phase in an amount of 40% to 65% in total in terms of area fraction, and a cementite in an amount of 5% or less in terms of area fraction at a position located at ¼ of the thickness from the surface of the steel sheet, and a metallurgical microstructure including a ferrite phase in an amount of 40% to 55% in terms of area fraction at a position located at 50 μm in the thickness direction from the surface of the steel sheet, wherein the steel sheet has a bendability, represented by a ratio of a limit bending radius (R) to a thickness (t) of the steel sheet (R/t) of 2.5 or less, with bendability being measured in accordance with JIS Z 2248, and wherein the steel sheet has a product of tensile strength (TS) and ductility (El) of 12500 MPa·% or more, with tensile strength being measured in accordance with JIS Z 2241 (2011).

2. The high-strength, cold-rolled steel sheet having a tensile strength of 980 MPa or more according to claim 1, the chemical composition further containing, by mass %, at least one selected from V: 0.005% to 0.100% and REM: 0.0010% to 0.0050%.

3. A method for manufacturing a high-strength, cold-rolled steel sheet having a tensile strength of 980 MPa or more, the method including:

hot rolling a steel material having the chemical composition according to claim 1 with a finishing delivery temperature of a $Ar_3$ transformation temperature or more, coiling the hot-rolled steel sheet at a temperature of 600° C. or lower, performing pickling followed by cold rolling, and performing an annealing treatment, wherein, the annealing treatment comprises heating the cold-rolled steel sheet to a temperature of 600° C. or lower at an average heating rate of 0.15° C./min or less, holding the cold-rolled steel sheet at an annealing temperature of 700° C. to ($Ac_3$-5°) C. for 5 hours to 50 hours, and then cooling the cold-rolled steel sheet to a temperature of 620° C. or higher at an average cooling rate of 1.2° C./min or more.

4. A method for manufacturing a high-strength, cold-rolled steel sheet having a tensile strength of 980 MPa or more, the method including:

hot rolling a steel material having the chemical composition according to claim 2 with a finishing delivery temperature of a $Ar_3$ transformation temperature or more, coiling the hot-rolled steel sheet at a temperature of 600° C. or lower, performing pickling followed by cold rolling, and performing an annealing treatment, wherein, the annealing treatment comprises heating the cold-rolled steel sheet to a temperature of 600° C. or lower at an average heating rate of 0.15° C./min or less, holding the cold-rolled steel sheet at an annealing temperature of 700° C. to ($Ac_3$-5°) C. for 5 hours to 50 hours, and then cooling the cold-rolled steel sheet to a temperature of 620° C. or higher at an average cooling rate of 1.2° C./min or more.

* * * * *